United States Patent [19]

Dominguez

[11] 4,402,361

[45] Sep. 6, 1983

[54] HEAT EXCHANGER

[75] Inventor: Aurelio D. Dominguez, Godoy Cruz, Argentina

[73] Assignee: Inquimet Sociedad Anonima Industrial Comercial Y Agraria, Argentina

[21] Appl. No.: 293,195

[22] Filed: Aug. 17, 1981

[30] Foreign Application Priority Data

Aug. 29, 1980 [AR] Argentina ..... 282361

[51] Int. Cl.[3] ..... F28D 7/12

[52] U.S. Cl. ..... 165/156; 165/76; 165/164

[58] Field of Search ..... 165/156, 164, 165, 140, 165/141, 146, 147

[56] References Cited

FOREIGN PATENT DOCUMENTS 1270051 7/1960 France ..... 165/156

*Primary Examiner*—Albert W. Davis, Jr.
*Assistant Examiner*—John F. McNally
*Attorney, Agent, or Firm*—Lerner, David, Littenberg, Krumholz & Mentlik

[57] ABSTRACT

A heat exchanger, especially for the processing of food or pharmaceutical products comprising at least two coaxially superimposed frusto-conical jackets defining an annular space therebetween. Inlet and outlet means for a first fluid are connected to opposite ends of said annular space, and a spacer in the form of a conical helix is freely and releasably disposed in said annular space in contact with the opposite conical surfaces thereof. The spacer and the conical surfaces defining a helical fluid channel leading from the inlet means to the outlet means. Means are provided for releasably attaching the frusto-conical jackets at their large ends and for sealing the large end of said annular space. The first fluid exchanges heat with a second fluid in contact with a surface of one of said jackets contiguous but exterior to said annular space.

Preferably, the exchanger comprises three coaxially superimposed frusto-conical jackets defining two adjacent annular spaces, each having a helical spacer therein defining helical fluid channel for two different fluids in heat exchange relationship.

The heat exchanger may be readily disassembled for cleaning purposes. Cleaning is facilitated by the removal of the helical spacer and the fact that the conical surfaces of the jackets are smooth. The helical spacer may be changed by a different one having a different pitch, cross section or coiled in the opposite direction in order to change to flow rates and/or velocities and/or residence times and/or direction of flow of the fluids.

13 Claims, 2 Drawing Figures

HEAT EXCHANGER

BACKGROUND OF THE INVENTION

This invention refers to a heat exchanger and, more particularly, to a heat exchanger for the processing of food or pharmaceutical products in utmost sanitary conditions.

In many industrial processes, and specially in the food industry, it is necessary to heat or cool large volumes of a fluid by absorbing heat from or transferring heat to another fluid which is at a higher or lower temperature, respectively.

The most common heat exchangers comprise a cluster of straight, helical or serpentine tubes arranged inside an enclosure or shell. A first fluid flows through the tubes while a second fluid flows back and forth across the tubes between baffles. Heat exchange between the first and second fluids takes place across the walls of the tubes.

The quantity of heat transferred is governed by three main factors; (a) the extension and nature of the heat transfer surface exposed to both fluids; (b) the overall coefficient of heat transfer from one fluid through the intervening wall to the other fluid; and (c) the mean temperature difference across the intervening wall from one fluid to the other.

The first item depends upon the number of tubes employed and their length. The second depends upon the resistance to the flow of heat created by the tube walls and the thin films of stagnant fluid on either sides of the walls. The third factor depends upon the difference in temperature between the first and second fluids at the inlet and exit to the exchanger.

The overall coefficient of heat transfer depends, to a large extent, upon the film coefficients of the stagnant fluid layers. The important physical properties which affect film coefficients are thermal conductivity, viscosity, density and specific heat. Factors within the control of the designer include velocity of flow, and shape and arrangement of the heating surface.

For the first fluid flowing through the tubes, the velocity is determined quite precisely by the flow rate and the number and diameter of the tubes. The velocity of the second fluid, which flows inside the shell across the tubes, also depends on the flow rate and the passage sections defined among the tubes, but flow conditions may vary considerably from one area to another of the exchanger.

Since for a given heat exchange area, the exchanger efficiency is substantially improved when the velocity of the second fluid increases, several designs have been proposed wherein the second fluid also circulates through channels of controlled cross section at high velocity and in turbulent flow conditions in intimate contact with the tube or tubes through which the first fluid circulates. However, such designs are complex and of costly construction, or difficult to disassemble and re-assemble and/or have unaccessible or rugous surfaces which cannot be cleaned with simple methods or inspected visually in order to ensure that they strictly adhere to adequate sanitary conditions. Therefore, these known heat exchangers are not intended nor adapted for use in applications where thorough and frequent cleaning of the internal parts of the exchanger is required nor in processes which do not tolerate even minute amounts of contaminants.

Thus, convencional heat exchangers must be cleaned with chemicals of energic action, for instance by circulating a hot nitric acid solution through the exchanger. This procedure is not desirable inasmuch as the use of chemicals does not ensure complete elimination of solid particles which may be retained or entrapped inside the exchanger. Furthermore, some of these chamicals may attack the metal surfaces of the exchanger, or the sealing gaskets, or leave contaminant residues.

On the other hand, the food industry is essentially seasonal, and the necessity often arises of treating food products of different nature and which should be processed at different operative conditions. Since known heat exchangers are designed for specific process requirements, a change in the product to be treated imposes the need of using a different exchanger with the attending capital investment.

Therefore, it is desirable to provide an efficient heat exchanger of simple construction, easy to clean and which could be adapted, at a minimum cost, to the treatment of fluids having different viscosities and specific gravity and requiring different flow rates, velocities, residence times and relative flow directions.

Among the heat exchangers of the prior art, the following are mentioned:

French Pat. No. 2155770 discloses a heat exchanger wherein a first fluid flows through a helically wound tube arranged between two walls of revolution in order to define, between the tube coils, another helical path for a second fluid. The heat transfer takes place across the wall of the helical tube.

In the exchanger of the above French patent, one of the fluids must flow through a helical tube the interior of which is obviously unaccessible. Besides, the exchanger of this patent cannot be disassembled easily and cleaning of the outer surface of the helical tubes would be too difficult or time-consuming. Furthermore, the heat exchanger of this patent is of complex and costly construction.

German Pat. No. 1111654 employs a similar concept. A helically corrugated tubular element is arranged between an inner and an outer cylindrical walls so as to define a first helical path for a first fluid between the outer wall and the corrugated element, and a second helical path for a second helical path for a second fluid between the corrugated element and the inner wall. The heat transfer takes surfaces. Finally, these exchangers have complex inlet and outlet channels which are difficult to disassemble and have unreliable seals at which the interacting fluids may contact accidentally.

None of the above patents disclose a heat exchanger in which the flow conditions of the interacting fluids may be changed to adapt them to specific requirements.

SUMMARY OF THE INVENTION

The present invention overcomes the shortcomings of the prior art by providing a heat exchanger comprising at least two frusto-conical jackets each having a conical wall, a small end closed by a transverse end wall and a large end. The frusto-conical jackets are coaxially superimposed to define an annular space between said conical walls. The annular space has smooth conical surfaces, a large end and a smaller end. Inlet means for a first fluid communicate with one end of said annular space and outlet means for said first fluid communicate with the other end of said annular space. A spacer comprising a conical helical element or conical helix of constant cross section is freely and releasably mounted in the annular space between the jackets in contact with the opposite conical surfaces thereof, said conical surfaces and said spacers having substantially the same conicalness, i.e. their diameters vary substantially at the same rate in the same direction. The spacer and the conical surfaces define a helical fluid passage leading from the inlet means to the outlet means. Means are provided for releasably attaching the jackets at their large ends and for sealing the large end of said annular space, and for contacting a surface at least one of said jackets, contiguous but external to said annular space, with a second fluid in order to exchange heat between said first and second fluids. The heat exchanger may be readily disassembled for cleaning purposes. Cleaning is facilitated by the removal of the helical spacer and the fact that the conical place across the wall of the tubular corrugated element.

In Swiss Pat. No. 535,929, a first fluid flows through a straight tube surrounded by a cylindrical shell. A helical spacer is coiled about the tube and disposed between the shell and the tube, whereby a helical path is defined for a second fluid. The heat exchange takes place across the wall of the tube.

The exchangers of the German and Swiss patents have unaccessible surfaces with crevices in which decomposable products might be retained. Besides scales, deposits, etc. formed on the cylindrical surfaces would make disassembly extremely difficult.

U.S. Pat. No. 2,405,256 discloses a heat exchanger comprising a plurality of conical sections stamped with helical grooves and corresponding ridges. The conical sections are stacked so as to define therebetween alternate spiral paths for the interacting fluids. The conical sections have, at their bases, peripheral flanges of different radii and thickness mounted in inlet and outlet structures which distribute and collect the fluids, respectively.

A similar concept is disclosed in U.S. Pat. No. 3,303,877. This patent refers to a heat exchanger consisting of a plurality of frusto-conical sections having helical ribs or ridges stamped thereon which, upon being stacked, define helical conduits for the interacting fluids. Each frustoconical section has a radially extending flange at the large end, and an end plate closing the small end. The interacting fluids enter and exit through openings in the flanges and in the end plates, the inlets and outlets being isolated by a complicated sealing structure.

The heat exchangers of the above U.S. patents are made of stamped sections which are necessarily rather small and consequently of limited capacity. Besides, the heat exchangers of these patents have rugose surfaces which are very difficult to clean and to inspect visually, specially the grooved inner surfaces of the jackets are smooth. The helical spacer may be changed by a different one having a different geometrical configuration to change the flow characteristics of the fluid.

It is an object of this invention to provide a heat exchanger for food and pharmaceutical products which can be readily disassembled and has only smooth surfaces which are easily accessible for cleaning and inspection.

Another object of the invention is to provide a heat exchanger in which both the primary and the secondary fluids flow at great velocity, with turbulent flow and through closely adjacent paths in order to improve heat transmission therebetween and consequently enhance the exchanger overall efficiency.

A further object of the invention is to provide a heat exchanger constructed with standardized parts and in which the cross section of the flow channels may be varied in order to adapt the flow rate and/or the velocity of the fluid and/or the residence time, to specific requirements.

The foregoing and other objects of the invention will become apparent in the course of the following description, with reference to the accompanying drawings.

DESCRIPTION OF THE PREFERRED EMBODIMENT

Figure 1:
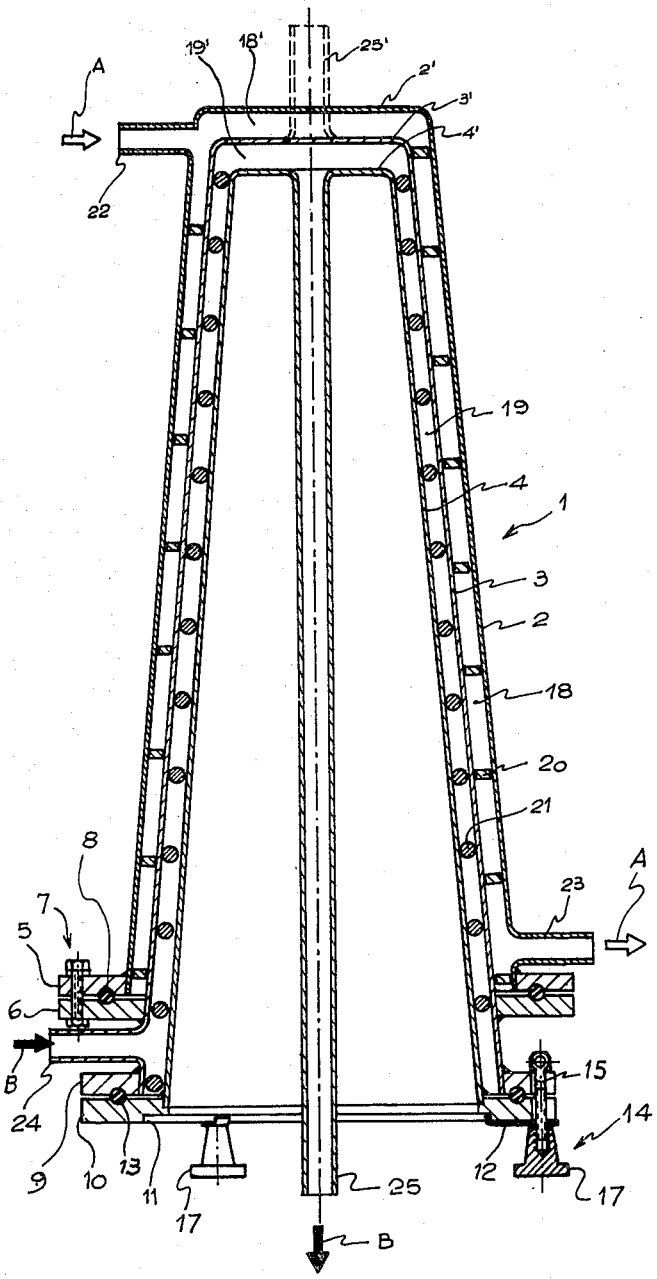
FIG. 1 is a longitudinal, somewhat schematic section of a preferred embodiment of the heat exchanger of the invention.
Figure 2:
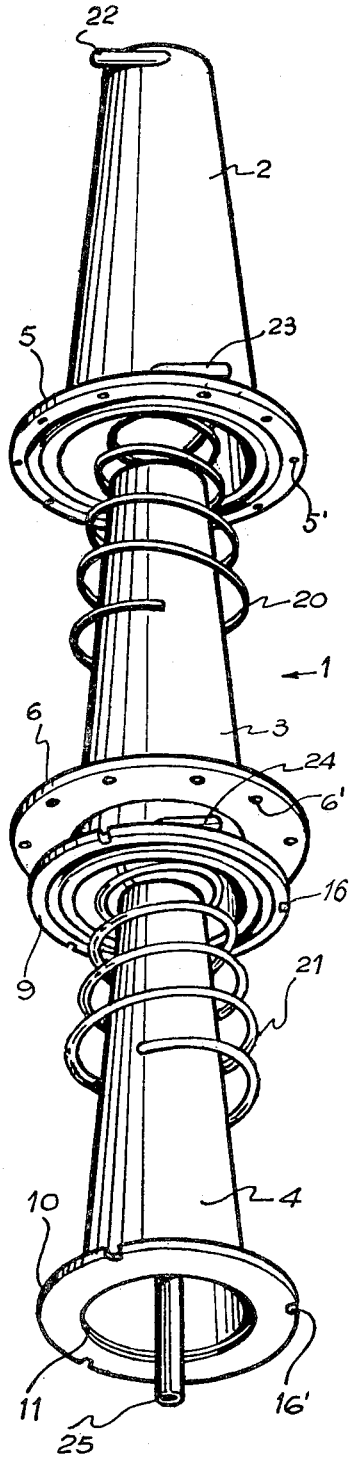
FIG. 2 is an exploded view of the heat exchanger of FIG. 1.

Referring in detail to the drawings, 1 designates a heat exchanger embodying the invention which comprises an outer jacket 2, an intermediate jacket 3 and an inner jacket 4 arranged coaxially one inside the other. The three jackets are frusto-conical and have the same conicalness, i.e. their diameters vary at the same rate in the same direction. The smaller ends of the jackets are closed by respective transversal walls or end plates 2', 3' and 4'.

A radial flange 5 is welded at the larger end of the outer jacket 2 and a radial flange 6 is welded to the wall of the intermediate jacket 3 in the vecinity of its larger end. Flanges 5 and 6 have a series of equally spaced, registering openings 5' and 6' which permit attaching them by means of bolts and nuts 7 with an intervening gasket 8.

Similarly, radial flanges 9 and 10 are welded at the larger ends of the intermediate and inner jackets 3 and 4, respectively. Flange 10 has an annular recess defining a peripheric shoulder 11. A gasket 13 is arranged between flanges 9 and 10.

Gaskets 8 and 13 have been shown as thoroidal rings retained in circular grooves machined in the opposite faces of the respective flanges, although a different type of gasket could be used. Gaskets 8 and 13 are made of an elastomeric material, such as neoprene.

In the embodiment shown in FIG. 1, flanges 9 and 10' are attached by a plurality of quick release clamps 14 mounted at equal spaces on flange 9. Each clamp 14 comprises a bolt 15 pivotally connected, at one end, to flange 9 and capable of nesting in aligned notches 16 and 16' at the edges of flanges 9 and 10. The other end of bolt 15 has a threaded portion. A knob 17 is screwed on the threaded portion of the bolt and upon being tightened clamps a latch 12 on shoulder 11 of flange 10.

The length of jackets 2, 3 and 4 and the height of flange 6 relative to the edges of the larger end of the intermediate jacket 3 are determined so that first and second annular spaces 18 and 19 and first and second transversal spaces 18' and 19' are defined between adjacent jackets 2-3 and 3-4, the width of these spaces being established as a function of the flow rate and flow conditions required for the fluids which will circulate therethrough.

First and second spacing elements 20 and 21, consisting of a helically coiled wire, strip or tube of uniform cross section are disposed in the annular spaces 18 and 19, respectively, in contact with the opposite conical surfaces of the adjacent jackets.

Thus, the spacing elements or spacers 18 and 19 define with the opposite walls of the adjacent jackets, helical channels leading from one end of the respective annular space to the opposite end of such space.

A first inlet tube 22 is provided close to the smaller end of the outer jacket 2, and a first outlet tube 23 is provided close to the larger end of this jacket. For the purpose of clarity, inlet and outlet tubes 22 and 23 have been shown in FIG. 1 as projecting radially from the wall of jacket 2 although in practice they are arranged tangentially to decrease heat losses as much as possible. Tubes 22 and 23 are for the inlet and exit, respectively, of a first fluid, for example water or steam (indicated by arrows A). If steam is used, spacer 20 may be omitted.

Adjacent the larger end of the intermediate jacket 3, a second inlet tube 24 is provided which communicates with the annular space 19 between the intermediate and inner jackets 3 and 4. This tube is also arranged tangentially to the wall of the intermediate jacket 3 although it is shown in FIG. 1 as extending radially for the purpose of clarity.

A second outlet tube 25, which is arranged substantially along the longitudinal axis of the heat exchanger assembly, communicates with the transverse space between end walls 3' 30 and 4'.

Outlet tube 25 extends through the inside of jacket 4 and projects through its larger end. For certain applications requiring more strict cleaning conditions for the inner jacket, tube 25 (shown in full lines) may be replaced by another tube 25' (shown in phantom lines) extending in the opposite direction and projecting outwardly through an opening in end wall 2', in which case a suitable seal (not shown) whould be disposed between the opening and the end tube.

Tubes 24 and 25 (or 25') are for the inlet and exit, respectively, of a second fluid, for example, a food product, such as beer, wine, fruit juices, milk, etc. (indicated by arrows B).

Of course the terms "inlet" and "outlet" are used for convenience and only as an example since the direction of flow of one or both fluids could be inverted to adapt it to the characteristics and requirements of the process in question.

In operation, a first fluid, for example hot water, enters through inlet tube 22, circulates through the helical channel defined by spacer 20 between the opposite surfaces of the outer and intermediate jackets 2 and 3 and exits through outlet tube 23, while a second fluid, for example, a food product such as milk or wine, enters through tube 24, flows through the helical channel defined by spacer 16 and the opposite surfaces of intermediate and inner jackets 3 and 4 and exits through central tube 24 or 25'. Heat is exchanged across the wall of the intermediate jacket.

To improve the efficiency of the heat exchanger the same fluid flowing through the annular space 18, or a different fluid, may be circulated inside the inner jacket 4 in heat exchanging relationship with the wall thereof. To these ends, a disc (not shown) could be attached to flange 10 in order to close the larger end of the inner jacket 4, and additional inlet and outlet tubes could be provided through the closure disc. The inner end of the inlet tube could terminate close to the inner surface of the disc while the inner end of outlet tube could terminate close to end wall 4'. In this embodiment, it would be convenient that the second fluid exits via tube 25' to facilitate disassembly and cleaning of the inner jacket.

The heat exchanger may be easily disassembled for cleaning purposes by separating flanges 5, 6 and 9, 10.

In the embodiment shown in FIG. 1, flanges 5 and 6 attaching the outer and intermediate jackets are secured together by volts and nuts 7 inasmuch as the helical channel therebetween is intended for the flow of water or steam and the surfaces defining such channel do not require cleaning as frequently as the opposite surfaces of the intermediate and inner jackets, which would be in contact with a food product such as fruit pulp or a syrup. However, it would be possible to replace the bolts and nuts 7 by quick release clamps 14, similar to those securing flanges 9 and 10 together, or by a different fastening device.

Although the embodiment shown comprises only three frusto-conical jackets defining two flow paths for the first and second fluids, it will be understood that it is possible to provide more than three superimposed jackets in order to increase the residence time of the fluids, or to process more than two fluids simultaneously.

It is also possible to provide a heat exchanger with only two jackets and this invention contemplates specifically a heat exchanger wherein a first fluid flows through a helical channel defined by a coiled spacer between two coaxial, superimposed frusto-conical jackets, and a second fluid is in contact with the inner surface of the inner jacket and/or the outer surface of the outer jacket, for example, by placing the assembly consisting of the two jackets and its intermediate spacer within a container filled with the second fluid.

Such heat exchanger might also comprise two or three coaxial assemblies, each consisting of a pair of frustoconical jackets and an intermediate spacer element defining a helical channel therebetween. Each of said assemblies would be radially spaced from the adjacent assembly to define an annular passage therebetween. Thus, a first fluid (for instance a food product) would flow in series or in parallel through the helical channels or each assembly and a second fluid (for example hot water, steam, or hot combustion gases) would flow through the annular passage or passages between adjacent assemblies. This embodiment has not been shown inasmuch as it could be readily envisioned by those expert in the art, and does not depart essentially from the main principles of this invention.

The foregoing heat exchanger provides a series of structural and functional advantages which simplify manufacturing, reduce costs, facilitate cleaning and make it extremely flexible to different process requirements.

The fact that the heat exchanger is made of frustoconical jackets permits increasing manufacturing tolerances and greatly facilitates disassembly.

Since the helical spacers are also conical, they rest on the conical surface of the underlying jacket and are held in position without any additional fastening elements. The resiliency of the spacers enable them to self-adjust to the enclosing conical surfaces.

It is important to point out that, if the jackets were cylindrical, it would have been very difficult to detach one from the other and from the helical spacers when sediments, scales or other deposits have been formed on the surfaces in contact with the fluids (for instance carbon deposits or scales produced when syrup or fruit pulp and juices are processed). In that case, the coils of the spacers would wedge between the cylindrical surfaces and might be deformed rendering the opening of the exchanger even more difficult.

In the case of this invention, the spacers are freely and releasably mounted and therefore, capable of detaching themselves from either one of the opposite surfaces of the adjacent jackets.

Besides, even if the coils of the helical spaces of the heat exchanger of the invention should be deformed during disassembly, their resiliency would enable them to re-adjust to the original shape upon being replaced in position and pressed between the enclosing jackets.

An important feature of the invention is that both the inner and outer surfaces of the frusto-conical jackets are smooth and may be thoroughly cleaned and visually inspected to ensure absolute cleanness.

The possibility of replacing the helical spacers by others of different pitch, cross section or winding direction, permits varying the specifications of the apparatus within broad ranges in order to adapt it to the particular requirements of the products to be treated with a minimum capital investment. In other words, a single heat exchanger may handle different flow rates at different fluid velocities and residence times by merely changing the helical spacers.

The following examples demonstrate this flexibility.

EXAMPLE 1

Table I illustrates the possibility of varying certain specifications of the heat exchanger by changing both the cross section and the pitch of the coils of the helical spacer. Experiences were conducted with three spacers having round cross sections of different diameters and different pitches selected such that the cross sectional areas of the helical channels remained constant in all cases.

The flow rate was kept constant at 4,500 l/hr, the cross sectional area of the helical channel was 2.5 $cm^2$, and the fluid velocity 5 m/sec. Dimensions of the frustoconical jackets were: major diameter 320 mm; minor diameter 160 mm; height 1,800 mm and surface area 1.36 $m^2$. The fluid was water.

TABLE I

| | 1 | 2 | 3 |
|---|---|---|---|
| Diameter of spacer (mm) | 1 | 5 | 10 |
| Pitch (mm) | 250 | 50 | 25 |
| Velocity of fluid (m/sec) | 5 | 5 | 5 |
| Reynolds Number | 9960 | 45454 | 71428 |
| Heat transfer coefficient (kcal/hr/$m^2$/°C.) | 790 | 2300 | 2700 |
| Number of coils | 7.2 | 36 | 72 |
| Length of fluid path (m) | 5.428 | 27.142 | 54.28 |
| Residence time (sec) | 1.085 | 5.42 | 10.85 |

It should be noted that the Reynolds number (which is a function of the equivalent diameter of the flow channels and the velocity, viscosity and specific gravity of the fluid) and the coefficient of heat transfer increase considerably upon decreasing the pitch of the helical spacer. The residence time and the loss of head increased due to the increased length of the fluid path.

In order to accomodate an increased cross section of the spacer coils and a larger separation between adjacent jackets, it is necessary to increase the thickness of flanges 5, 6, 9 and/or 10 or place adequate shims therebetween.

EXAMPLE 2

Table II illustrates the effect of changing the pitch of the helical spacer. In the experiences, spacer coils having different pitches but the same rectangular cross section (3×10 mm) were used. The flow rate was held constant at 6,000 l/hr. The dimensions of the jackets were the same as in the previous examples, i.e. major diameter 320 mm; minor diameter 160 mm; height 1,800 mm and surface area 1.36 $m^2$. The fluid was water.

TABLE II

| | 1 | 2 | 3 | 4 |
|---|---|---|---|---|
| Cross section of coil (mm × mm) | 10 × 3 | 10 × 3 | 10 × 3 | 10 × 3 |
| Pitch (mm) | 100 | 75 | 50 | 30 |
| Velocity of fluid (m/sec) | 1.66 | 2.22 | 3.33 | 5.55 |
| Reynolds number | 30000 | 39176 | 56353 | 83250 |
| Heat transfer coefficient (kcal/hr/$m^2$/°C.) | 1700 | 2000 | 2300 | 3200 |
| Cross section of passage ($m^2$) | 0.001 | 0.00075 | 0.00055 | 0.0003 |
| Number of coils | 18 | 24 | 36 | 60 |
| Length of fluid path (m) | 13.6 | 18 | 27 | 45 |
| Residence time (sec) | 8.1 | 8.1 | 8.1 | 8.1 |

It should be noted that the velocity of the fluid increases upon decreasing the pitch (i.e. the cross section of the helical channel defined by the spacer element). The Reynolds number, and consequently, the heat transmission coefficient also increased. The residence time remains constant upon decreasing the pitch since the fluid path, while longer, is travelled at a higher velocity.

Obviously, upon varying the flow rate while maintaining the velocity constant, the residence time will vary when the fluid path is longer. This is very important in the treatment of citric juices, specially lemon juice, which are very sensitive to residence times.

For certain applications it may be desirable to maintain the coefficient of heat transfer constant throughout the heat exchanger. Since the relationship between the cross section of the helical passages and the radial distance of said passages to the longitudinal axis of the exchanger vary, the Reynolds number and the coefficient of heat transmission will also vary along the axis of the exchanger assuming all other parameters remain constant. Therefore, it may be possible to design a spacer whose pitch varies in such a way that the Reynolds number—and the coefficient of heat transfer—is maintained constant from inlet to outlet.

From the foregoing it follows that with a standardized jacket assembly, it is possible to vary the specifications of the heat exchanger in order to adapt it to particular requirements by simply changing the size and/or the pitch and/or the winding direction of the spacers.

The heat exchanger of the invention has a series of advantages which will be summarized as follows:

a. The apparatus is completely sanitary; all its parts may be easily disassembled and cleaned quickly and thoroughly with the simplest cleaning utensils and products (brushes, soap, detergents, etc.) without resorting to costly cleaning operations with chemicals (for example recirculation of a nitric acid solution at high temperatures). Chemical cleaning is very complicated and costly and does not ensure the complete removal of solids, hairs, threads and all type of particles which remain inside heat exchangers. The heat exchanger of the invention is free from this problem since it can be fully disassembled in a few minutes to remove deposits on its walls as well as any foreign solid that may have remained therein.

b. Use of a removable helical spacer permits replacing it by another one of a different pitch or cross section to vary the characteristics of the fluid vein. By increasing or decreasing the velocity of the fluid or by varying the characteristics of the section of passage, the Reynolds number may be changed thus increasing or decreasing the coefficient of heat transfer. When the coils are closer, for a given exchanger length, the fluid path is longer, and if the velocity is maintained constant, the residence time will increase resulting in higher temperatures when the fluid is heated and lower temperatures when the fluid is cooled.

c. The possibility of changing the pitch of the coils permits changing the area of the helical channels to adapt it to variations in the viscosity of the treated fluids. Thus, when a highly viscous fluid (for instance glycerine, oils, syrups, etc) is treated, it is possible to provide a helical spacer whose pitch decreases gradually or stepwise towards the area of increasing temperature in order to increase the velocity of the fluid and the coefficient of heat transfer.

d. By simply installing shims between the flanges, it is possible to vary the radial width of the annular space between jackets in order to use helical spacers having larger cross sections which define larger passage sections for the fluid. It is also possible to replace the inner jacket with a smaller one. The cost of changing spacers is minor, and so is the cost of replacing a jacket, specially when these elements are standardized.

e. The number of seals required is minimal and there is no possibility that the interacting fluids may contact and contaminate each other across the gaskets as in the case of the above mentioned U.S. patents.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications and variations which fall within the spirit and scope of the appended claims.

We claim:

1. A heat exchanger comprising at least two frusto-conical jackets each having a conical wall, a small end closed by a transverse end wall and a large end, said jackets being coaxially superimposed to define an annular space between said conical walls, said annular space having opposite smooth conical surfaces, a large end and a smaller end; inlet means for a first fluid communicating with one end of said annular space and outlet means for said first fluid communicating with the other end of said annular space; a spacer comprising a conical helical element of constant cross section freely and releasably mounted in the annular space between said jackets in contact with the opposite conical surfaces thereof, the diameters of said conical surfaces and of said spacer varying at substantially the same rate in the same direction; said spacer and said conical surfaces defining a helical fluid channel leading from the inlet means to the outlet means; means for releasably attaching the jackets at their large ends and for sealing the large end of said annular space whereby said spacer may be removed from said annular space and replaced by another spacer having the same or different geometrical configuration, and means for contacting a surface of at least one of said jackets, contiguous but external to said annular space with a second fluid in order to exchange heat between said first and second fluids.

2. A heat exchanger as claimed in claim 1, wherein a transverse space is defined between the end walls of said jacket said transverse space communicating with said annular space.

3. A heat exchanger comprising an outer, an intermediate and an inner frusto-conical jackets, each having a conical wall, a small end closed by a transverse end wall and a large end, said jackets being coaxially superimposed to define a first annular space between the conical walls of said outer and intermediate jackets and a second annular space between the conical walls of said intermediate and inner jackets, each of said annular spaces having opposite conical smooth surfaces, a large end and a smaller end; a spacer comprising a conical helical element freely and releasably mounted in at least one of said annular spaces in contact with the opposite conical surfaces thereof, the diameters of said conical surfaces and of said spacer varying at substantially the same rate in the same direction; said spacer and said at least one annular space defining a helical fluid channel leading from one end of said annular space to the other end thereof; inlet and outlet means for a first fluid connected to opposite ends of said first annular space, and inlet and outlet means for a second fluid connected to opposite ends of said second annular space, said first and second fluids flowing through said annular spaces and exchanging heat across the wall of said intermediate jacket; and means for releasably attaching the jackets at their large ends and for sealing and isolating the large ends of said annular spaces, whereby said jackets may be disassembled and said spacer removed from said annular space and replaced by another spacer having the same or different geometrical configuration.

4. A heat exchanger as claimed in claim 3, wherein a first transverse space is defined between the end walls of said outer and intermediate jackets and a second transverse space is defined between the end walls of said intermediate and inner jackets, said first and second annular spaces communicating with said first and second transverse spaces, respectively.

5. A heat exchanger as claimed in claims 3 or 4 wherein a helical spacer is disposed in each of said annular spaces, whereby first and second helical channels are defined therein, said helical fluid channels communicating the respective inlet and outlet means.

6. A heat exchanger as claimed in claim 3, wherein said releasable attaching and sealing means comprise a first radial flange at the large end of said outer jacket, a second radial flange at the large end of said intermediate jacket, a third radial flange spaced from said second flange and attached to the wall of said intermediate jacket, and a fourth radial flange at the large end of said inner jacket, releasable fastening means for securing said first and third flanges and said second and fourth flanges and sealing gaskets between said cooperating flanges.

7. A heat exchanger as claimed in claims 1 or 3, wherein said helical element is replaceable by others having different pitch and/or cross section and/or winding direction in order to change the flow characteristics of the fluid in contact therewith.

8. A heat exchanger as claimed in claim 5 wherein the helical spaces in said first and second annular spaces have different pitches and/or cross sections and/or winding directions.

9. A heat exchanger as claimed in claim 5 wherein said spacers are resilient whereby they may self-adjust to the adjoining conical surfaces.

10. A heat exchanger comprising at least two coaxial assemblies as claimed in claim 1, each assembly being radially spaced from an adjacent assembly and defining an annular passage therebetween, the helical channel of each assembly being in fluid connection with the helical channel in an adjacent assembly, means for circulating a first fluid through said helical channels, and means for circulating a second fluid through the annular passages between adjacent assemblies.

11. A heat exchanger comprising at least two frustoconical jackets each having a conical wall, a small end closed by a transverse end wall and a large end, said jackets being coaxially superimposed to define an annular space between said conical walls, said annular space having opposite smooth conical surfaces, a large end and a smaller end; inlet means for a first fluid communicating with one end of said annular space and outlet means for said first fluid communicating with the other end of said annular space; a spacer comprising a conical helical element freely and releasably mounted in the annular space between said jackets in contact with the opposite conical surfaces thereof, said spacer and said conical surfaces defining a helical fluid channel leading from the inlet means to the outlet means; means for releasably attaching the jackets at their large ends and for sealing the large end of said annular space whereby said spacer may be removed from said annular space and replaced by another spacer having the same or different geometrical configuration, and means for contacting a surface of at least one of said jackets, contiguous but external to said annular space with a second fluid in order to exchange heat between said first and second fluids.

12. A heat exchanger as claimed in claim 11 wherein said spacer has a pitch which varies over its length.

13. A heat exchanger as claimed in claim 3 wherein said spacer has a pitch which varies over its length.

* * * * *